US007940156B2

(12) United States Patent
Vetter et al.

(10) Patent No.: US 7,940,156 B2
(45) Date of Patent: May 10, 2011

(54) POWER RESISTOR MODULE

(75) Inventors: Leonhard Vetter, Landau-Wollmesheim (DE); Norbert Buchlaub, Hagenbach (DE)

(73) Assignee: DBK David + Baader GmbH, Kandel/Pfalz (DE)

( * ) Notice: Subject to any disclaimer, the term of this patent is extended or adjusted under 35 U.S.C. 154(b) by 572 days.

(21) Appl. No.: 12/075,615

(22) Filed: Mar. 12, 2008

(65) Prior Publication Data

US 2008/0266047 A1 Oct. 30, 2008

(30) Foreign Application Priority Data

Apr. 2, 2007 (EP) ..... 07006864

(51) Int. Cl.
*H01C 1/02* (2006.01)

(52) U.S. Cl. ..... 338/269; 338/296

(58) Field of Classification Search ..... 338/269, 338/51, 58, 141, 218, 267, 270, 296, 301, 338/297

See application file for complete search history.

(56) References Cited

U.S. PATENT DOCUMENTS

| | | | | |
|---|---|---|---|---|
| 3,789,191 | A * | 1/1974 | Spindler | 338/24 |
| 4,203,197 | A * | 5/1980 | Crandell | 29/611 |
| 2004/0178189 | A1 * | 9/2004 | Peyronny | 219/530 |

FOREIGN PATENT DOCUMENTS

| | | | |
|---|---|---|---|
| DE | 1 074 773 | B1 | 2/1960 |
| DE | 26 26 409 | A1 | 12/1977 |
| DE | 85 03 272.7 | U1 | 5/1985 |
| DE | 42 42 699 | A1 | 5/1993 |
| EP | 1 225 080 | B1 | 7/2002 |
| EP | 1 681 906 | B1 | 7/2006 |

* cited by examiner

*Primary Examiner* — Kyung Lee
(74) *Attorney, Agent, or Firm* — Seed Intellectual Property Law Group PLLC

(57) ABSTRACT

A power resistor module for electrical circuits has at least one resistor element and at least one housing element. The at least one resistor element is mounted at least section-wise between two electrically insulating, thermally conductive insulation elements in the housing element. The insulation elements at least section-wise abut against the at least one housing element. Methods for producing an electrical power resistor module for an electrical circuit include compressing, at least one resistor element with two electrically insulating, thermally conductive insulation elements. At least one of the two insulation elements is pressed at least section-wise against a housing element. If a wire is used as the resistor element, the use of possible fillers such as magnesium oxide may be waived by providing that the wire abuts at least section-wise against at least one of the two insulation elements during the compression.

26 Claims, 2 Drawing Sheets

POWER RESISTOR MODULE

BACKGROUND

1. Technical Field

The invention relates to a power resistor module for electrical circuits. The power resistor module comprises at least one resistor element and at least one housing element, wherein the at least one resistor element is mounted at least section-wise between two electrically insulating, thermally conductive insulation elements in the housing element and the insulations elements at least section-wise abut against the at least one housing element. The invention further relates to a method for producing an electrical power resistor module for an electrical circuit, wherein at least one resistor element is compressed between two electrically insulating, thermally conductive insulation elements and at least one of the two insulation elements is pressed at least section-wise against a housing element.

2. Description of the Related Art

Power resistor modules are known as protection elements in electrical circuits. Power resistor modules are often referred to as braking resistors, discharging resistors or protective resistors, and electrical heating elements. They transform electric energy to heat.

For example, a braking resistor reduces excessive electric energy during the braking operation of an electric motor, whereby it must first of all be ensured that the power resistor module safely transforms high-voltage pulses into heat and dissipates the same into the ambiance.

In the prior art, resistance wires are frequently employed in power resistor modules to transform the electric energy into heat. A heating wire of a defined resistance alloy and dimensioned in correspondence with the required power is wound onto one or more insulation plate(s). The free ends of the wire of such a wire-wound heating element are each connected to an electrical cable entry by welding, crimping, or the like. To obtain an improved heat storage capacity and heat transfer to the ambient environment, the wire-wound heating element is electrically insulated and coupled in a heat-transferring manner with an appropriate heat sink, e.g., an aluminum profile body.

In the prior art, techniques are known which allow the coupling of a wire-wound heating element to an aluminum heat sink in an electrically insulated and heat-transferring manner. EP 1 681 906 A1 describes a method for producing a heating element. In the method defined therein, first a lining made of micanite is incorporated into a profile body, e.g., an extruded aluminum profile, which is closed all over. Then, the wire-wound heating element is pushed into the profile, with an air space being provided on all sides around the wire-wound heating element. For this reason, the wire-wound heating element has to be appropriately positioned and fixed for the next production steps. On the side opposite the cable outlet the profile is then closed with another micanite plate. Next, the air space is filled with magnesium oxide. The magnesium oxide thermally couples the wire-wound heating element to the profile body and stores heat for a delayed heat transfer and buffering, as well as for electrical insulation. To be able to reliably fulfill these purposes, the magnesium oxide has to be compressed using a vibration process. Then, additional magnesium oxide is filled in, after which the profile body can be closed. To this end, another micanite plate is inserted in the feed side or cable side. The cable side may include cable openings for passing therethrough the connecting leads for the wire-wound heating element. Finally, the front faces of the profile are sealed with a silicone sealing layer and then with a cement layer.

In EP 1 225 080 A2 a protection element for an electrical circuit is described. Here, a PTC resistor element is disposed in a layered structure between two sheets, which are likewise electrically insulated by a film and are adjacent to a heat sink.

Moreover, an electrical heating element is described in DE 85 03 272U1. The electrical heating element comprises a PTC heating element clamped in a flat tube between two insulated plates of pressed micanite. The use of a heating wire or a heating wire filament is, however, not mentioned in DE 85 03 272 U1.

The use of PTC heating elements is problematical because they are made of a ceramic material and can, therefore, easily break if they are not handled with utmost care. Moreover, PTC heating elements are more expensive than resistance wires of a like capacity.

The methods known in the prior art for thermally coupling a wire-wound heating element to a profile body in an electrically insulated, thermally conductive manner and for sealing the profile body are time-consuming and expensive. Many production steps are necessary to fill the profile body with the magnesium oxide, and the costs for the sealing substances employed and the expenditure of time needed for their drying are too high as well.

BRIEF SUMMARY

Therefore, at least one embodiment of the invention is based on the object to simplify the production of a power resistor module without reducing the efficiency.

According to the invention, this object can be achieved by a power resistor module that includes at least one resistor element is a wire, which at least section-wise abuts against at least one insulation element, specifically under a preload.

This simple solution has the advantage that the wire can directly convey the generated thermal energy to the insulation element and is accommodated in the power resistor module by the housing element in an electrically insulated manner. By being adjacent or abutting under a preload, the insulation element and/or the wire is elastically deformed, and there is surface contact between the insulation element and the wire. This surface contact may satisfy the requirements for the heat transfer and storage of a generic power resistor module.

Various embodiments of the invention can be combined, as desired, with the following other advantageous features and embodiments and improved further.

In some embodiments, the surface contour of the wire is pressed and/or impressed at least section-wise into at least one of the insulation elements. This embodiment allows the wire to be embedded in the insulation element and to be surrounded by the material thereof, which is deformed elastically, plastically, or both so as to obtain an intimate contact.

In some embodiments, a power resistor module may not contain magnesium oxide. The time-consuming processing of the magnesium oxide can be waived and the material costs for the magnesium oxide are saved.

In some embodiments, it may be provided that the insulation element contains mica. Mica is a silicate mineral from natural sources, which has an electrically insulating effect and is temperature-resistant up to more than 600° C.

According to some embodiments, the insulation elements are made of a plate-shaped, pressed mica material. Pressed mica material is also known as artificial mica or micanite and is made of mica compressed with a heat-resistant binder, which, with papers impregnated with a binder and subjected to heat and high pressure, may also be compressed in several layers to form plates. The compressed mica material is likewise heat-resistant up to 600° C. and usually has an electric or breakdown strength of more than 10 kV/mm.

According to some embodiments, it may be provided that the at least one housing element is an extruded profile. Thus, the at least one housing element can be easily manufactured by simply cutting an extruded profile having the desired cross-section to length. The extruded profile can be a hollow profile, having an opening on at least one side and forming at least one receiving channel in which the at least one wire and the insulation elements are received. Thus, the extruded profile shaped as a hollow profile forms a solid housing body for the power resistor module which is stable and easy to seal.

According to some embodiments, it is further possible that the at least one opening is sealed with an elastic seal. By the use of an elastic seal or a prefabricated sealing element, the use of possible sealing and auxiliary materials, such as silicone and cement, may be waived. It is thus possible to achieve fast and inexpensive sealing of a power resistor module.

Advantageously, the seal, in some embodiments, has at least one leadthrough receiving at least one electric conductor electrically connected to the at least one wire. Thus, the electric conductor can easily be lead out of the sealed interior of the power resistor module.

To improve the sealing of the leadthrough for the electric conductor, the sealing of the housing element can, in accordance with another embodiment, be improved in that the leadthrough is adapted in a compressed state of the seal to a cross-sectional shape of the electric conductor.

According to another possible embodiment, at least one wire can be wound at least section-wise onto a carrier. Thus, the wire can be easily inserted into the power resistor module in a desired wide or narrow layout in a uniform and surface-covering manner. This is particularly advantageous if the wire has no mechanical stability required for the mounting thereof and is difficult to handle on its own, particularly in mechanical applications. Certainly, wires having a material strength that is sufficient to insert the wire into the power resistor module in a desired layout can also be employed.

For handling the wire and its electrical lead more easily, at least one fixing means is mounted on the carrier. At least one wire and/or the at least one electric conductor is/are fixed via the fixing means. The fixing means can be fixed on the carrier. The fixing means can be a clamp, whereby the carrier can comprise the recesses or lugs. The wire and the electric conductor can then be fixed to this clamp or soldering lug, respectively, and are thus fixed to the carrier, which further improves the handling capability and the assembly of a power resistor module.

For a modular combination of several carriers to increase the heating capacity of a power resistor module, several carriers form at least one abutment in which an engaging element to connect the carriers is disposed. An overlapping of the carriers may be waived if the engaging element provides sufficient support. This is particularly advantageous if the power resistor module is planar and flat, because no use of additional filling, sealing, or auxiliary materials is necessary.

According to some embodiments, the carriers can have identical designs. For example, two plate-shaped carriers can have one axis of symmetry. Each carrier comprises a portion for forming the abutment, which is fittingly adjacent to a carrier rotated about the axis of symmetry. Thus, only one carrier type is needed, which simplifies the procurement of materials. The material procurement and production expenditure can be further reduced if the carrier and the insulation elements are substantially made of the same material.

According to some embodiments, at least one resistor element is mounted between the at least one housing element and at least one press-on element preloaded against the resistor element, which is held by at least one holder supported against the housing element. Thus, a pressure acting against the resistor element with respect to the housing element can be easily built up. For example, a metal plate may be used as the press-on element. It is, for example, possible that the housing element is a simple aluminum profile body provided with ribs on one side, e.g., on a flattened side of which the resistor element is disposed. The press-on element can then be pressed against the resistor element or the insulation elements surrounding the resistor element. Once the desired contact pressure has been reached, the press-on element can be easily fixed by the holder supported against the housing element. The holder may be a clamp enclosing the press-on element and the housing element. However, it may be premounted on or formed in the housing element and fixed by bending, snapping or any other friction-, form-, force- or material-fit closing or fixing techniques.

According to another embodiment, the wire is disposed between at least two housing elements, which are connected to each other by form-fit elements. Similar to the embodiments comprising one housing element and a press-on element, two substantially identical housing elements may compress the wire. Accordingly, the wire is mounted between the housing elements which, after providing the desired contact pressure, are connected to each other by appropriate form-fit elements, e.g., screws or rivets. It is also possible to connect the housing elements to each other in the desired position by using material-fit connecting techniques, such as welding, soldering, or gluing.

According to another embodiment, the assembly of a power resistor module can be generally simplified if the carrier and the insulation elements are substantially disposed in a flat stack structure. Thus, the carrier receiving the resistance wire can be sandwiched between the insulation elements. The carrier and the insulation elements thus form an easy to handle unit.

If the wire is compressed, the stack can be compressed in such a way that the sections of the carrier extending between the lengths of the wires and the respectively adjacent insulation element are in surface contact, so that the wire is completely embedded in a compact stack and is enclosed by the material of the carrier and the insulation elements.

According to another embodiment, the resistor element can be placed against the insulation element such that the at least one housing element is elastically deformed by producing a preloading force acting on the at least one resistor element.

With regard to the aforementioned method for producing a power resistor module for an electrical circuit, a wire is used as the resistor element, which, during the compression, is placed at least section-wise against at least one of the two insulation elements. Thus, an intimate contact between the wire and the insulation element can be easily produced, thereby ensuring desired heat transfer between the wire and the insulation element.

According to some methods for producing a power resistor module, the surface contour of the wire is pressed and/or impressed at least section-wise into at least one of the two insulation elements. The wire may have a round, flat or angular contour. Both the insulation element and the wire may be plastically deformed during the compression or impression process. By impressing the wire into the insulation element, the wire is practically embedded into and at least partially enclosed by the material of the insulation element so as to increase the size of the heat transfer surface between the wire and the insulation element. The heat transfer between the wire and the insulation element is thus improved, and the power resistor module may be more compact than traditional models.

In some embodiments, a method for producing a power resistor module for an electrical circuit is provided. A receiving channel is formed on the at least one housing element, into which the wire and the two insulation elements are inserted. The at least one housing element is compressed by plastically deforming the cross-section thereof, so that the wire and the insulation elements are compressed within the receiving channel. The housing element may be adapted to maintain a desired cross-sectional shape after applying the compressive forces. The housing element exerts a pressure acting on the wire and the insulation elements in the receiving channel to meet desired requirements. In order to fix the desired cross-sectional shape of the housing element, additional notches or impressions may be provided on the housing element, so that zones of maximum bending stresses are secured against unbending.

In some embodiments, a method for producing an electrical power resistor module includes winding the at least one wire at least section-wise onto a carrier. Thus, the wire can be inserted more easily into the power resistor module in the desired position and with a uniform, flat distribution, and the carrier can be used as an additional heat storage during the later operation.

In some embodiments, a method for producing a power resistor module includes clamping the at least one seal inserted into an opening of the at least one housing element in a sealing manner during a pressing process. By this, the use of additional sealing materials may be waived if the seal ensures sufficient sealing of the interior of the power resistor module.

By clamping in the seal during the pressing process, the complete power resistor module can be compressed and sealed in one single pressing process. Also, it is possible to compress the wire and the insulation elements before clamping. The seal can be subsequently clamped when compressing the receiving channel of one housing element or between several housing elements.

BRIEF DESCRIPTION OF THE SEVERAL VIEWS OF THE DRAWINGS

The invention will be explained by way of examples and in more detail below by means of preferred embodiments and with reference to the drawings. The embodiments as described merely represent possible embodiments whereby, as described above, the individual features may be realized independently of each other or may be omitted.

DETAILED DESCRIPTION

Figure 1:
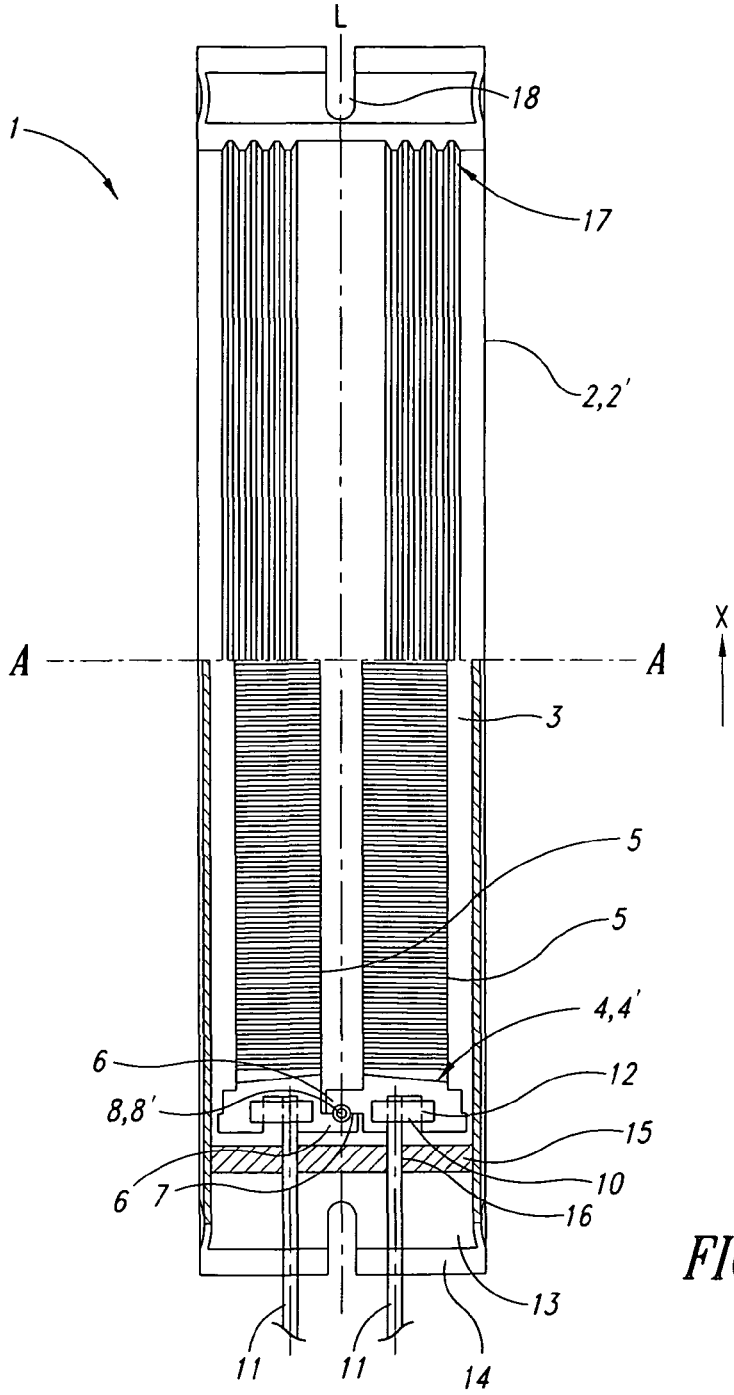
FIG. 1 shows a schematic top view and a half-side sectional view of a power resistor module according to some embodiments of the invention.

First, the architecture of a power resistor module 1 will be described with reference to FIG. 1, showing a schematic top view and a sectional view of the power resistor module 1.

The power resistor module 1 comprises a housing element 2, which is embodied as an aluminum profile 2'. The housing element 2 comprises a receiving channel 3 for a resistor element 4 which transforms electric energy into thermal energy. The resistor element 4 is in the form of a wire 4' wound onto two carriers 5. The carriers 5 include fixing portions 6, which form an abutment 7. In the center of the abutment 7, a form-fit element 8 in the form of a rivet 8' is inserted to connect the carriers 5 together. To allow a particularly flat design of the power resistor module 1, the carriers 5 do not overlap in the region near the abutment 7.

Moreover, a fixing means 9 in the form of a contact tag or soldering lug 9' is mounted on each of the two carriers 5, on which the wire 4' and the stripped end 10 of an electric conductor 11 is attached. To this end, the wire 4' may be soldered, welded or glued in an electrically conductive manner to its fixing point 12. In general, the connecting technique suited best in the respective case of application can be chosen to connect the wire 4' and the fixing means 9, which also refers to the attachment of the electric conductor 11 on the fixing means 9. The wire 4' or the resistor element 4 and the electric conductor 11 can also be connected to each other directly.

Seals 15, 15' are inserted in openings 13 of the front faces 14 of the housing element 2 to protect the receiving channel 3 of the housing element 2 against the penetration of dirt, liquids, and/or corrosive media. The electric conductor 11 is introduced from outside into the housing element 2 through a leadthrough 16 in the seal 15.

Moreover, ribs 17 are formed on the side of the housing element 2 facing away from the resistor element to enlarge the surface area and improve the heat transfer of the heat generated by the resistor element 4 to the ambient environment. The front faces 14 the housing element 2 may comprise mounting elements 17' serving to fix the power resistor module 1.

Figure 2:
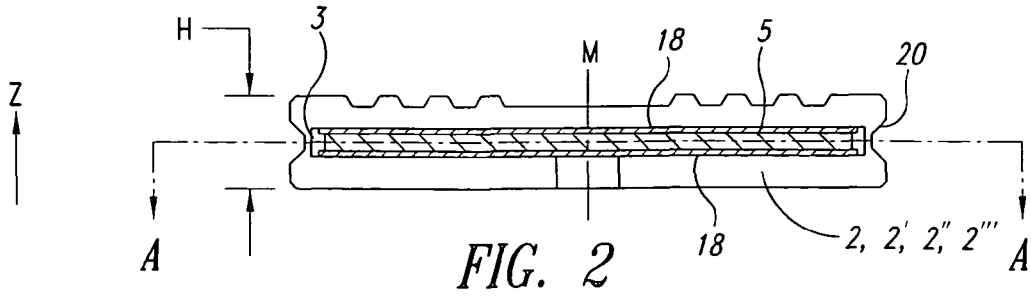
FIG. 2 shows a schematic sectional view of a power resistor module according to some embodiments of the invention.

FIG. 2 shows a power resistor module according to the invention in a sectional view along the intersection line A-A shown in FIG. 1. It is shown that the carrier 5 with the wire 4' is introduced into the receiving channel 3 of the housing element 2. The housing element 2 can be a hollow profile 2" or an extruded profile 2'''.

The carrier 5 is disposed between two insulation elements 18, so that the wire 4' mounted on the carrier 5 is electrically insulated from the housing element 2.

It can be seen in FIG. 2 that the two insulation elements 18 and the carrier 5 are disposed in layers in a flat stack structure 19 and are adjacent to each other in a flush manner. The wire 4' may be pressed into the insulation elements and/or the carrier 5 as a result of compressing the stack structure 19, so that the insulation elements 18 and/or the carrier 5 are impressed by the wire 4'. The wire 4' thus forms impressions in the insulation elements 18 and/or carriers 5. The carriers 5, as well as the insulation elements 18, are formed as plates of pressed micanite in which the wire 4' is buried, so as to ensure a good heat transfer from the wire 4' to the surrounding insulation elements 18. The intimate contact between the wire 4', carriers 5, and insulation elements 18 also ensures the heat storage capacity of the power resistor module 1. Thus, the use of possible fillers, such as magnesium oxide (MgO), can be waived. The use of prefabricated seals 15, 15' makes a sealing of the power resistor module 1 with possible auxiliary materials, such as silicone or the like, redundant.

FIG. 2 shows the sandwich-like or stack-like structure of a resistor module 1 that permits a very easy production of a power resistor module 1. The resistor element 4, the carrier 5, and the wire 4' wound onto the carrier 5, as well as the insulation elements 18, can easily be placed into the receiving channel 3 of the housing element 2. The housing element 2 can be a hollow profile 2" which is open on one side or both sides. Subsequently, the hollow profile 2" can be compressed along its center line M or in a surface-to-surface manner, so that its side surfaces 20 are arched toward the inside, thereby reducing the height H of the housing element 2. The side surfaces 20 can be impressed to improve the support by additional tools.

Then, as shown in FIG. 1 already, electric conductors 11 connected to the resistor element 4 or wire 4' project from a respective opening 13 in the housing element 2. The seal 15, 15' can already be inserted into the openings 13 in the hollow profile 2" before the housing element 2 is compressed, whereby the electric conductors 11 are passed through the leadthroughs 16 in the seal 15.

Figure 3:
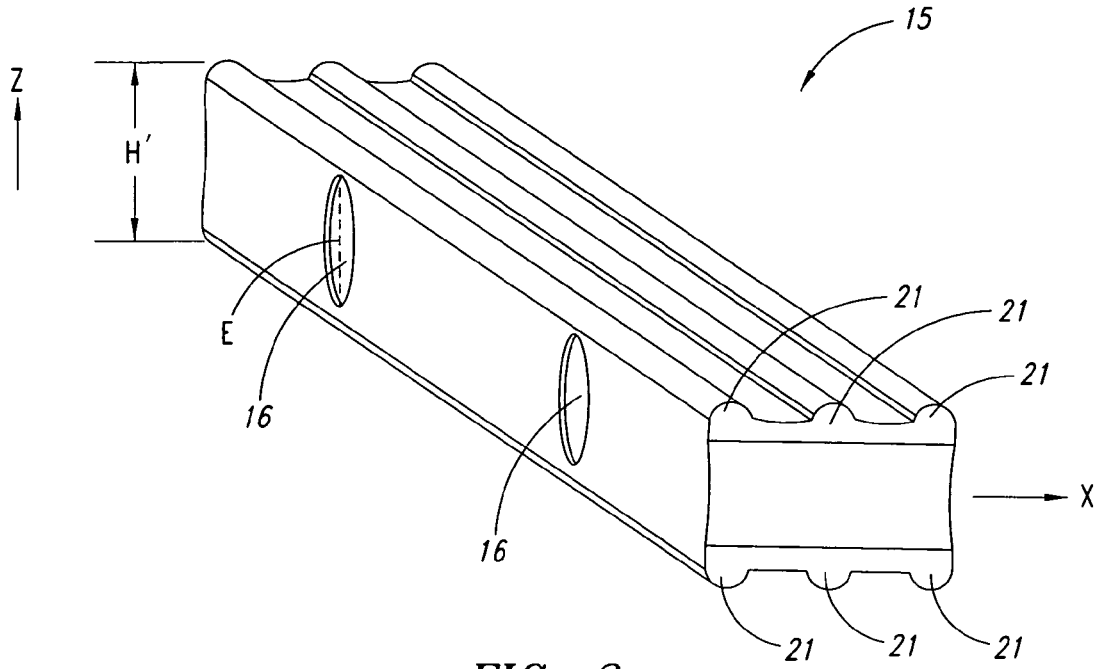
FIG. 3 shows a schematic perspective view of a seal for a power resistor module according to some embodiments of the invention.

FIG. 3 shows a schematic perspective view of the seal 15. The seal 15 can be inserted into the opening 13 in the housing element 2 in an introduction direction x. The electric conductors 11 are thereby passed through leadthroughs 16 in the seal 15. The seal 15 may also be designed as a seal 15' without leadthroughs 16 in case no electric conductors 11 are to be passed therethrough.

The leadthroughs 16 have an elliptical cross-section, with the major axis E of the elliptical leadthrough 16 being parallel with respect to an axis Z along which heights of the seal and the housing element can be measured. If the housing element 2 with the seal 15 being inserted is compressed in the Z-direction, not only the height H of the housing element 2, but also the height H' of the seal is reduced, and the major axes E of the ellipse are shortened until the leadthroughs 16 have, in an optimal manner, a circular cross-section. This ensures optimum sealing of electric conductors 11 having round cross-sections in the leadthroughs 16.

The seal 15 additionally includes lamellae 21, which additionally improve the sealing effect of the seal with the respect to the housing element 2.

Figure 4:
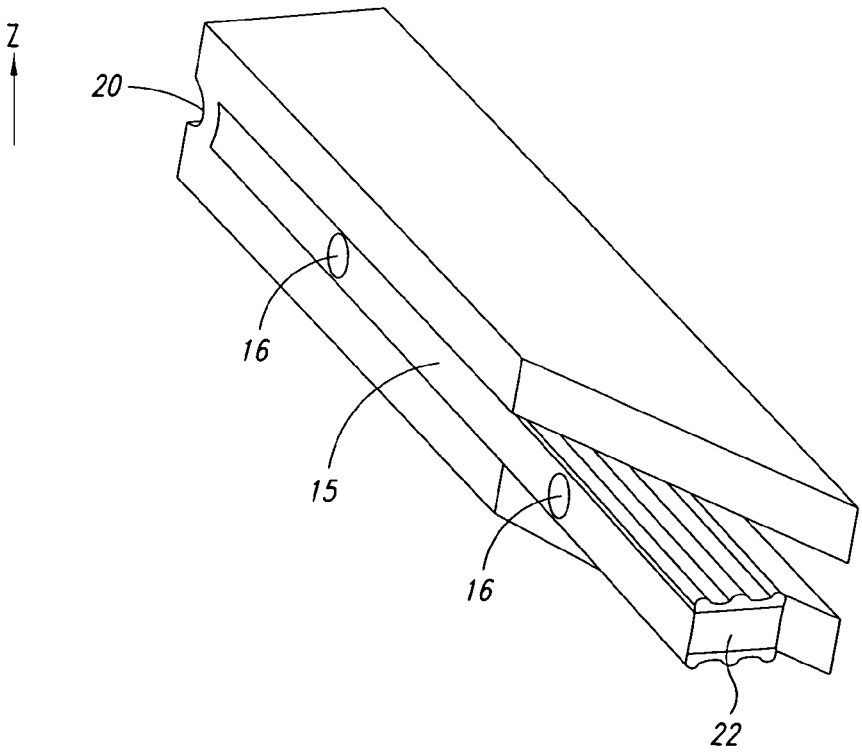
FIG. 4 shows schematic perspective view of a seal inserted into a power resistor module according to some embodiments of the invention.

FIG. 4 shows a schematic perspective view of a seal 15 inserted into the receiving channel 3 of the housing element 2. The housing element is already compressed in the Z-direction, so that the seal 15 is tightly enclosed by the housing element 2 and compressed in the Z-direction.

In the compressed state, as shown in FIG. 4, the leadthroughs 16 have a circular cross-section. To ensure proper sealing on the side surfaces 20 of the housing element 2, the seal 15 is slightly arched toward the inside at its side ends 22 or constricted concavely. Thus, the seal 15 optimally adapts to the side surfaces of the housing element 2, which are likewise impressed inwardly or constricted concavely, respectively, and an optimum sealing is ensured along the entire circumference of the seal 15 or the opening 13 in the housing element, respectively.

A skilled artisan recognizes that deviations from the above-described embodiments are possible. Thus, housing elements 2 can also be constructed as simple plate bodies with an insulation element 18 being adjacent thereto, into which a resistor element 4 or a corresponding power module is pressed and is thus embedded. Winding of the wire 4' onto a carrier 5 is optional and depends on the respective material strength of the resistor element 4. If the resistor element 4 has a sufficient stability, it may also directly be disposed between two insulation elements 18 and compressed.

A stack structure 19 can also be disposed between two housing elements 2 embodied as a plate body, which are pressed together and held together by possible form-fit elements.

Furthermore, it is also possible to form holders (not illustrated) on a housing element 2, which exert a contact pressure on a press-on element (not illustrated) maintaining the stack structure 19 in a compressed state.

The sealing of a power resistor module 1 with one or more seals 15, 15' is optional. Depending on the requirements, any types of sealing means can be employed to this end.

The plate-shaped configuration of insulation elements 18 is not required for pressing the resistor element 4 into the insulation element. Any desired geometrical shapes advantageously corresponding to each other of the resistor element 4, the housing element 2, and the insulation elements 18 are possible. Moreover, the insulation element 18 may be made of the beforementioned micanite as well as of any other electrically insulating, heat-resistant materials, e.g., polyimide. The insulation element 18 can, thus, also be realized as a film, e.g., a polyimide film (Kapton).

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A power resistor module for electrical circuits, comprising at least one resistor element and at least one housing element, wherein the at least one resistor element is mounted at least section-wise between two electrically insulating, thermally conductive insulation elements in the housing element and the insulation elements at least section-wise abut against the at least one housing element, wherein the at least one resistor element is a wire, which at least section-wise abuts against at least one of the insulation elements and is wound onto a carrier, the power resistor module further comprising at least one fixing element mounted on the carrier, at least one of the wire and an at least one electric conductor being electrically connected to the wire being fixed to the fixing element.

2. The power resistor module according to claim 1, wherein a surface contour of the wire is pressed and/or impressed at least section-wise into at least one of the insulation elements.

3. The power resistor module according to claim 1, wherein the power resistor module does not contain magnesium oxide.

4. The power resistor module according to claim 1, wherein at least one of the insulation elements contains mica.

5. The power resistor module according to claim 4, wherein the insulation elements are made of a plate-shaped, pressed mica material.

6. The power resistor module according to claim 1, wherein the at least one housing element is an extruded profile.

7. The power resistor module according to claim 6, wherein the extruded profile is a hollow profile having at least one opening on at least one side and forming at least one receiving channel, in which the wire and the insulation elements are received.

8. The power resistor module according to claim 7, wherein the at least one opening is sealed with an elastic seal.

9. The power resistor module according to claim 8, wherein the seal has at least one lead through receiving at least one electric conductor electrically connected to the wire.

10. The power resistor module according to claim 9, wherein the lead through is adapted in a compressed state of the seal to a cross-sectional shape of the electric conductor.

11. The power resistor module according to claim 1, wherein the wire is wound at least section-wise onto the carrier.

12. The power resistor module according to claim 1, further comprising a plurality of carriers that form at least one abutment in which a form-fit element to connect the carriers is disposed.

13. The power resistor module according to claim 12, wherein the carriers have substantially identical shapes.

14. The power resistor module according to claim 11, wherein the carrier and the insulation elements are substantially made of the same material.

15. A power resistor module for electrical circuits, the power resistor module comprising at least one resistor element and at least one housing element, wherein the at least one resistor element is mounted at least section-wise between two electrically insulating, thermally conductive insulation elements in the housing element and the insulation elements at least section-wise abut against the at least one housing element, wherein the at least one resistor element is a wire, which at least section-wise abuts against at least one of the insulation elements, wherein the at least one resistor element is mounted between the at least one housing element and at least one press-on element preloaded against the at least one resistor element, which is held by at least one holder supported against the at least one housing element.

16. The power resistor module according to claim 1, wherein the wire is disposed between at least two housing elements that are connected to each other by form-fit elements.

17. The power resistor module according to claim 11, wherein the carrier and the insulation elements are substantially disposed in a flat stack structure.

18. The power resistor module according to claim 1, wherein the at least one housing element is elastically deformed by producing a preloading force acting on the at least one resistor element.

19. A method for producing an electrical power resistor module for an electrical circuit, the method comprising:

compressing at least one resistor element with two electrically insulating, thermally conductive insulation elements;

pressing at least one of the two insulation elements at least section-wise against a housing element, such that a wire of the at least one resistor element is placed at least section-wise against at least one of the two insulation elements and wound onto a carrier;

mounting at least one fixing element on the carrier; and fixing at least one of the wire and at least one electrical conductor that is electrically connected to the wire to the fixing element.

20. The method for producing the electrical power resistor module according to claim 19, wherein a surface contour of the wire is pressed and/or impressed at least section-wise into at least one of the two insulation elements.

21. The method for producing the electrical power resistor module according to claim 19, further comprising:

inserting the two insulation elements and wire into a receiving channel on the housing element; and compressing the housing element by plastically deforming the cross-section thereof, so that the wire and the insulation elements are compressed within the receiving channel.

22. The method for producing the electrical power resistor module according to claim 19, further comprising winding the wire onto the carrier.

23. The method for producing the electrical power resistor module according to claim 19, further comprising inserting at least one seal into an opening of the housing element such that the at least one seal is clamped in a sealing manner during a pressing process.

24. The power resistor module according to claim 1, wherein at least a portion of the at least one resistor element is positioned between the two electrically insulating, thermally conductive insulation elements.

25. The method for producing the electrical power resistor module according to claim 19, further comprising winding the wire section-wise onto the carrier.

26. A method for producing an electrical power resistor module for an electrical circuit, the method comprising:

compressing at least one resistor element with two electrically insulating, thermally conductive insulation elements;

pressing at least one of the two insulation elements at least section-wise against a housing element, such that a wire of the at least one resistor element is placed at least section-wise against at least one of the two insulation elements; and mounting the at least one resistor element between the at least one housing element and at least one press-on element preloaded against the at least one resistor element, which is held by at least one holder supported against the at least one housing element.

* * * * *